US008064629B2

(12) United States Patent
Jiang

(10) Patent No.: US 8,064,629 B2
(45) Date of Patent: Nov. 22, 2011

(54) DECORATIVE LOUDSPEAKER GRILLE

(76) Inventor: Peigen Jiang, Sammamish, WA (US)

( * ) Notice: Subject to any disclaimer, the term of this patent is extended or adjusted under 35 U.S.C. 154(b) by 1090 days.

(21) Appl. No.: 11/862,198

(22) Filed: Sep. 27, 2007

(65) Prior Publication Data

US 2009/0087001 A1 Apr. 2, 2009

(51) Int. Cl.
*H04R 1/02* (2006.01)
*H04R 1/20* (2006.01)

(52) U.S. Cl. ..... 381/391; 181/150; 181/199; 381/388; 381/189

(58) Field of Classification Search ..... 381/189, 381/186, 391, 386, 388; 181/150, 156, 199
See application file for complete search history.

(56) References Cited

U.S. PATENT DOCUMENTS

| | | | | | |
|---|---|---|---|---|---|
| 1,311,430 | A | * | 7/1919 | Williams | 381/391 |
| 1,767,656 | A | * | 6/1930 | Edelman | 381/393 |
| 3,696,885 | A | * | 10/1972 | Grieg et al. | 181/141 |
| 3,848,090 | A | * | 11/1974 | Walker | 381/152 |
| 4,244,096 | A | * | 1/1981 | Kashichi | 29/432 |
| 4,296,280 | A | * | 10/1981 | Richie | 381/99 |
| 4,439,643 | A | * | 3/1984 | Schweizer | 381/395 |
| 4,466,505 | A | * | 8/1984 | Ritter | 181/144 |
| 4,598,789 | A | * | 7/1986 | Ritter | 181/144 |
| 4,926,962 | A | * | 5/1990 | Graham et al. | 181/150 |
| 4,934,480 | A | * | 6/1990 | Gate et al. | 181/150 |
| 5,082,083 | A | * | 1/1992 | Draffen | 181/150 |
| 5,113,968 | A | * | 5/1992 | Lemmon | 181/148 |
| 5,299,766 | A | * | 4/1994 | Curtis et al. | 248/27.1 |
| 5,322,979 | A | * | 6/1994 | Cassity et al. | 181/150 |
| 5,400,412 | A | * | 3/1995 | King et al. | 381/395 |
| 5,400,413 | A | * | 3/1995 | Kindel | 381/189 |
| 5,412,162 | A | * | 5/1995 | Kindel | 181/150 |
| D389,484 | S | * | 1/1998 | Blackmon | D14/214 |
| 5,717,171 | A | * | 2/1998 | Miller et al. | 181/150 |
| 5,888,439 | A | * | 3/1999 | Miller et al. | 264/248 |
| 6,142,254 | A | * | 11/2000 | Claybaugh et al. | 181/199 |
| 6,385,326 | B1 | * | 5/2002 | Peng | 381/386 |
| 6,741,720 | B1 | * | 5/2004 | Myatt | 381/386 |
| 6,925,191 | B2 | * | 8/2005 | Petroff et al. | 381/423 |
| 6,993,145 | B2 | * | 1/2006 | Combest | 381/391 |
| 6,995,906 | B2 | * | 2/2006 | Edney | 359/450 |
| 7,292,702 | B2 | * | 11/2007 | Hagman | 381/345 |
| 7,346,181 | B2 | * | 3/2008 | Rivera | 381/391 |
| 7,353,907 | B2 | * | 4/2008 | Whitaker | 181/150 |
| 7,387,151 | B1 | * | 6/2008 | Payne | 160/371 |
| 7,455,272 | B2 | * | 11/2008 | Monti | 248/309.1 |
| 7,699,138 | B2 | * | 4/2010 | Struthers et al. | 181/150 |
| 2002/0176597 | A1 | * | 11/2002 | Petroff et al. | 381/430 |
| 2004/0057109 | A1 | * | 3/2004 | Edney | 359/443 |
| 2005/0281429 | A1 | * | 12/2005 | Rivera | 381/391 |
| 2005/0286729 | A1 | * | 12/2005 | Harwood et al. | 381/152 |
| 2006/0215866 | A1 | * | 9/2006 | Francisco et al. | 381/345 |
| 2008/0078609 | A1 | * | 4/2008 | Struthers et al. | 181/150 |
| 2009/0087001 | A1 | * | 4/2009 | Jiang | 381/189 |
| 2009/0175485 | A1 | * | 7/2009 | Petrie | 381/390 |

FOREIGN PATENT DOCUMENTS

GB 2 288 513 A * 10/1995

* cited by examiner

*Primary Examiner* — Mary Wilczewski

(57) ABSTRACT

A loudspeaker grille for a wall-mount loudspeaker in a home environment is disclosed, which comprises a frame attached directly to a wall where a loudspeaker being mounted, the loudspeaker enclosure lending no support to the frame, and a cover stretched across the frame, the cover being substantially transparent to acoustic energy, wherein the cover provides protection as well as decoration to the underneath loudspeaker.

15 Claims, 1 Drawing Sheet

DECORATIVE LOUDSPEAKER GRILLE

BACKGROUND

The present invention relates generally to loudspeakers, and, more particularly, to grilles for the loudspeakers.

Loudspeaker grilles are designed mainly to protect loudspeaker drivers from mechanical impact as well as to prevent ambient dust to accumulate on the diaphragms of the loudspeaker drivers. Conventional loudspeaker grilles are made of a piece of dark colored cloth stretched over a frame which is then attached to the enclosure of a loudspeaker. Apparently the cloth used in the loudspeaker grilles must be substantially transparent to acoustic energy. Such dark colored loudspeaker grille is alright for stand-alone loudspeakers, but would be unsightly when being used for wall-mount loudspeakers which are increasing popular in home theater systems.

Another kind of conventional loudspeaker grille has printed illustrations on the grille cloth to be more decorative. However, this kind of loudspeaker grille is still mounted on the loudspeaker enclosure, therefore, a particular grille can only be used for a particular loudspeaker.

As such, what is desired is a decorative loudspeaker grille for a wall-mount loudspeaker that is not limited to a particular loudspeaker.

SUMMARY

The present invention discloses a loudspeaker grille for a wall-mount loudspeaker in a home environment. The loudspeaker grille comprises a frame attached directly to a wall where a loudspeaker being mounted, the loudspeaker enclosure lending no support to the frame, and a cover stretched across the frame, the cover being substantially transparent to acoustic energy, wherein the cover provides protection as well as decoration to the underneath loudspeaker.

The construction and method of operation of the invention, however, together with additional objects and advantages thereof, will be best understood from the following description of specific embodiments when read in connection with the accompanying drawings.

Figure 1:
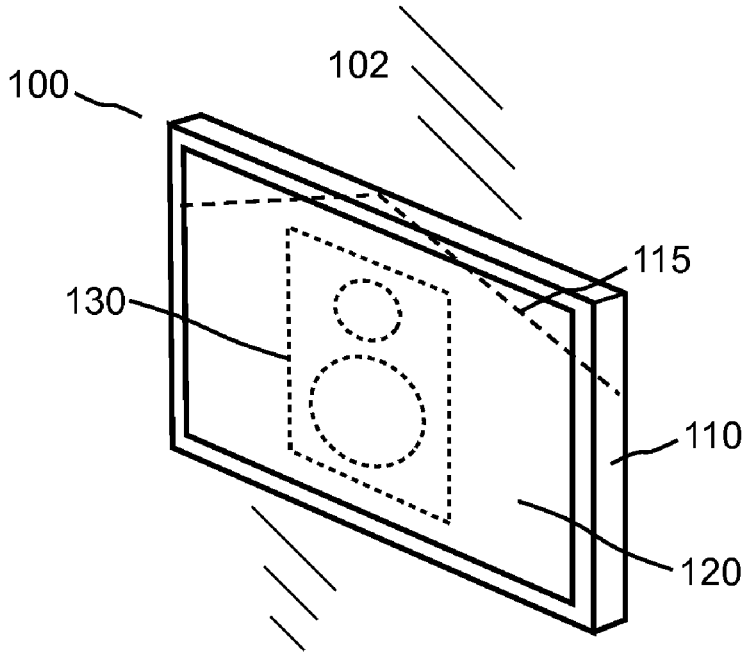
FIG. 1 is a perspective view of a loudspeaker grille hung on a wall according to one embodiment of the present invention.

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein. It should be noted that the features illustrated in the drawings are not necessarily drawn to scale.

DESCRIPTION

The following will provide a detailed description of a loudspeaker grille that is used to protect and decorate a wall-mount loudspeaker. The loudspeaker grille can be hung on the wall and is detached from the wall-mount loudspeaker itself.

FIG. 1 is a perspective view of a loudspeaker grille 100 hung on a wall 102 according to one embodiment of the present invention. The loudspeaker grille 100 comprises a frame 110, a cloth 120 stretched across the frame 110. The cloth 120 is substantially transparent to acoustic energy and may be printed with a graphic illustration so that loudspeaker grille 100 can serve as a cover for a wall-mount loudspeaker 130 and at the same time as a decorative art work. The loudspeaker grille 100 is hung onto the wall 102 by a string 115 attached to the frame 120. A skilled artisan may appreciate that other perforated material may also be used in place of the cloth 120.

Figure 2A:
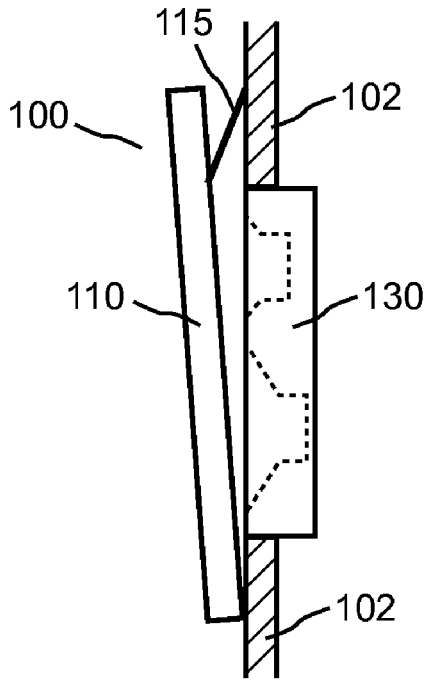
FIGS. 2A and 2B are side partially sectional views of the loudspeaker grilles hung on the walls according to embodiments of the present invention.
Figure 2B:
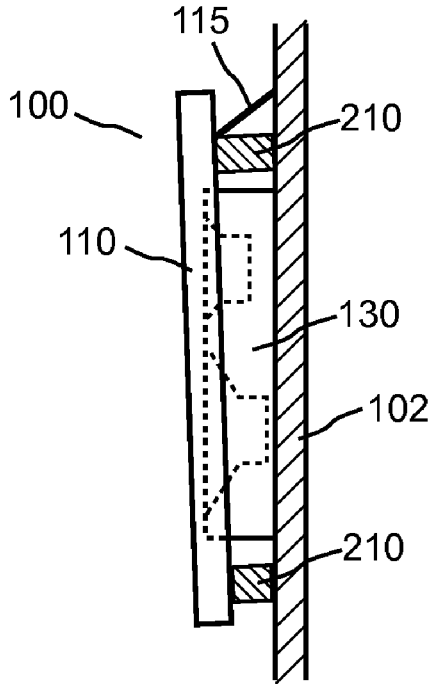

FIGS. 2A and 2B are side partially sectional views of the loudspeaker grilles hung on the walls according to embodiments of the present invention. Referring to FIG. 2A, the loudspeaker 130 is mounted inside the wall 102 through an opening in the wall 102, therefore the loudspeaker grille 110 is hung on the wall 102 by the string 115 like a conventional picture frame. Referring to FIG. 2B, the loudspeaker 130 is mounted on a surface of the wall 102. In order to keep the cloth 120 not to touch the loudspeaker 130, spacer blocks 210 are attached to the frame 110 to maintain a distance between the loudspeaker grille 100 and the wall 102.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A loudspeaker grille for a wall-mount loudspeaker in a home environment, the loudspeaker grille comprising:

a frame attached directly to a wall where a loudspeaker enclosure being mounted, the loudspeaker enclosure lending no support to the frame; and a cover stretched across the frame, the cover being substantially transparent to acoustic energy, wherein the cover provides protection as well as decoration to the underneath loudspeaker.

2. The loudspeaker grille of claim 1, wherein the frame is made of wooden material.

3. The loudspeaker grille of claim 1, wherein the cover is made of fabric material.

4. The loudspeaker grille of claim 1, wherein the cover has an illustrative pattern for decorative purpose.

5. The loudspeaker grille of claim 1, wherein the loudspeaker is mounted through an opening in the wall.

6. The loudspeaker grille of claim 1 further comprising a spacer attached to the frame for keeping the loudspeaker grille away from the wall.

7. A loudspeaker grille for a wall-mount loudspeaker in a home environment, the loudspeaker grille comprising:

a frame attached directly to a wall where a loudspeaker enclosure being mounted, the loudspeaker enclosure lending no support to the frame; and a cloth stretched across the frame, the cloth being substantially transparent to acoustic energy, wherein the cloth provides protection as well as decoration to the underneath loudspeaker.

8. The loudspeaker grille of claim 7, wherein the frame is made of wooden material.

9. The loudspeaker grille of claim 7, wherein the cloth has an illustrative pattern for decorative purpose.

10. The loudspeaker grille of claim 7, wherein the loudspeaker is mounted through an opening in the wall.

11. The loudspeaker grille of claim 7 further comprising a spacer attached to the frame for keeping the loudspeaker grille away from the wall.

12. A loudspeaker grille for a wall-mount loudspeaker in a home environment, the loudspeaker grille comprising:

a frame attached directly to a wall where a loudspeaker enclosure being mounted, the loudspeaker enclosure lending no support to the frame; and a cloth stretched across the frame, the cloth having an illustrative pattern for decorative purpose and being substantially transparent to acoustic energy, wherein the cloth provides protection as well as decoration to the underneath loudspeaker.

13. The loudspeaker grille of claim 12, wherein the frame is made of wooden material.

14. The loudspeaker grille of claim 12, wherein the loudspeaker is mounted through an opening in the wall.

15. The loudspeaker grille of claim 12 further comprising a spacer attached to the frame for keeping the loudspeaker grille away from the wall.

* * * * *